US009287664B2

(12) United States Patent
Hashimoto

(10) Patent No.: US 9,287,664 B2
(45) Date of Patent: Mar. 15, 2016

(54) CONNECTOR

(71) Applicant: Sumitomo Wiring Systems, Ltd., Yokkaichi (JP)

(72) Inventor: Norihito Hashimoto, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 14/506,757

(22) Filed: Oct. 6, 2014

(65) Prior Publication Data

US 2015/0111407 A1 Apr. 23, 2015

(30) Foreign Application Priority Data

Oct. 21, 2013 (JP) ..... 2013-218525

(51) Int. Cl.
*H01R 13/627* (2006.01)
*H01R 13/639* (2006.01)

(52) U.S. Cl.
CPC ..... *H01R 13/639* (2013.01); *H01R 13/6273* (2013.01)

(58) Field of Classification Search
CPC ..... H01R 13/639; H01R 13/6273; H01R 13/641; H01R 13/4362; H01R 13/4367
USPC ..... 439/352, 489, 595
See application file for complete search history.

(56) References Cited

U.S. PATENT DOCUMENTS 6,824,417 B1 * 11/2004 Nimura ..... H01R 13/641 439/352
7,252,530 B2 * 8/2007 Shamoto ..... H01R 13/641 439/352
8,449,319 B2 * 5/2013 Fujii ..... H01R 13/7032 439/489
8,920,187 B2 * 12/2014 Kon ..... H01R 13/641 439/352
2011/0076093 A1 * 3/2011 Makino ..... H01R 13/506 403/290

* cited by examiner

*Primary Examiner* — Xuong Chung Trans
(74) *Attorney, Agent, or Firm* — Gerald E. Hespos; Michael J. Porco; Matthew T. Hespos

(57) ABSTRACT

A connection detector (40) has two connection detection function portions (41) individually corresponding to two lock arms (30) and joined by a detecting portion (45). The connection detector (40) is held at an initial position when a male connector (M) and a housing (20) are not connected properly and can move to a detection position when the male connector (M) and the housing (20) are connected properly. The detecting portion (45) is formed with a lock (48) that restricts a movement of the connection detector (40) at the initial position toward a side opposite to the detection position to be separated from the housing by being locked to a stopper (24) of the housing (20).

5 Claims, 13 Drawing Sheets

CONNECTOR

BACKGROUND

1. Field of the Invention

The invention relates to a connector.

2. Description of the Related Art

US Patent Application Pub. No. 2011/0076093 discloses a connector with two lock arms formed respectively on opposite left and right outer side surfaces of a housing and the housing is locked in a connected state by the lock arms. A connector that has two lock arms may be connected with only one of the two arms locked, and the other lock arm left unlocked. Thus, it is desirable to provide a connection detector that functions in association with movements of the lock arms.

A connection detector that functions in association with movements of two lock arms is thought to be formed by integrally molding two connection detection function portions individually corresponding to the two lock arms and a detecting portion coupling the connection detection function portions. If the two connection detection function portions are coupled in this way, states of the two lock arms can be detected by one action.

A structure similar to that in the case of a connector including only one lock arm can be applied to the connection detection function portions in the above connection detecting member. However, even one connection detection function portion complicates the structure. Thus, a connection detector with two connection detection function portions further complicates the structure.

The invention was completed based on the above situation and aims to simplify the structure of a connection detector that has two connection detection function portions corresponding respectively to two lock arms.

SUMMARY OF THE INVENTION

The invention relates to a connector that includes a housing that is connectable to a mating connector. Left and right lock arms are formed respectively on opposite left and right side surfaces of the housing. The lock arms resiliently deform in the process of connecting the mating connector and the housing due to interference with locks formed on the mating connector. The lock arms disengage from the lock portions and resiliently return when the mating connector and the housing are properly connected. A connection detector is formed by coupling two connection detection function portions individually corresponding to the lock arms by a detecting portion. The connection detector is mounted movably on the housing, is held at an initial position by locking the connection detection function portions and the lock arms to each other in a state where the mating connector and the housing are not properly connected, and is permitted to move to a detection position by unlocking the connection detection function portions and the lock arms from each other in a state where the mating connector and the housing are connected properly. A stopper is formed on the housing; and a lock which is formed on the detecting portion and restricts a movement of the connection detector at the initial position toward a side opposite to the detection position to be separated from the housing by being locked to the stopper.

The lock for restricting movement of the connection detector at the initial position toward the side opposite to the detection position to be separated from the housing is not provided individually on each of the connection detection function portions, but on the detecting portion. Thus, only one lock is necessary. Thus, a structure is simplified as compared with a connection detector including locks individually provided on a pair of connection detection function portions.

The housing may be connectable to the mating connector with the connection detector detached, and the stopper may project from a rear surface of the housing and be bent to be substantially L-shaped. According to this configuration, the housing can be used with the connection detector detached, and an operation of separating the housing from the mating connector can be performed easily by placing a finger on the stopper.

The connector may include a plurality of terminal accommodating chambers formed in the housing. Seal towers may constitute rear end parts of the terminal accommodating chambers and may project from the rear surface of the housing. The stopper may be connected to outer surfaces of the seal towers. According to this configuration, the stopper has high strength and reliably restricts separation of the connection detector as compared with a stopper projecting back from the rear surface of a housing. Additionally or alternatively, the detecting portion may be arranged to extend along the rear surface of the housing and may be bent to avoid the seal towers. According to this configuration, interference of the detecting portion and the seal towers can be avoided.

The detecting portion may be arranged in contact with or proximately facing the rear surface of the housing when the connection detector is at the detection position. The rear ends of the lock arms are located behind the rear surface of the housing. This displacement in a front-back direction means that an area behind the rear surface of the housing is a dead space. However, the detecting portion is accommodated in this dead space, to which the rear surface of the housing is facing, when the connection detector is at the detection position. Thus, the connector can be miniaturized in the front-back direction.

DETAILED DESCRIPTION

A male connector M and a female connector F of this embodiment are illustrated in FIGS. 1 to 13. The connectors F, M are locked in a connected state by two lock arms 30 provided on the female connector F and the connected state is detected by a connection detector 40 provided on the female connector F.

Figure 4:
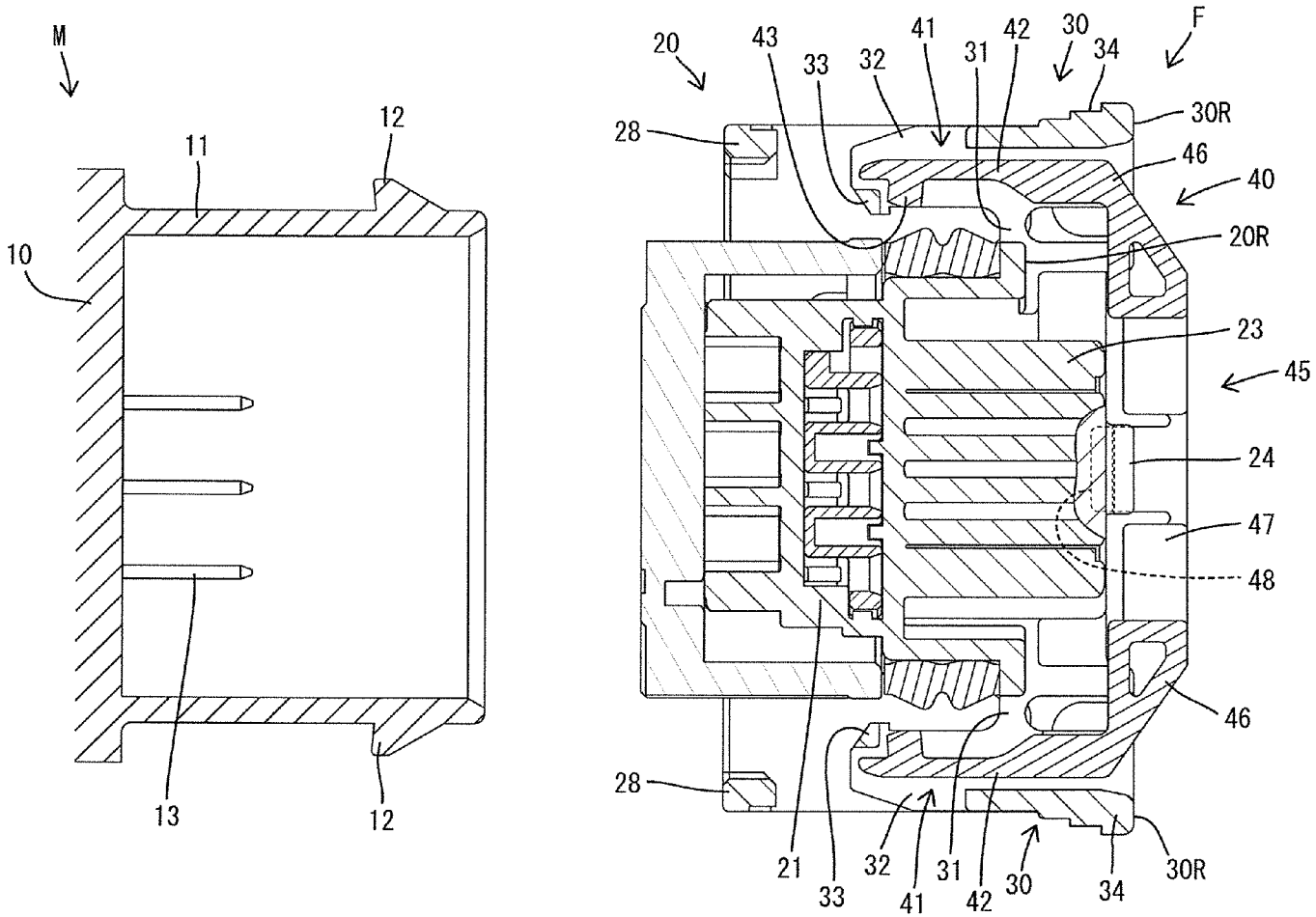
FIG. 4 is a section along X-X of FIG. 1 showing a state before the connector is connected to a mating connector

The male connector M includes a terminal holding portion 10 for holding male terminal fittings 13 and a rectangular tubular receptacle 11 projecting unitarily forward (right in FIGS. 4 to 7) from the outer periphery of the terminal holding portion 10, as shown in FIG. 4. Bilaterally symmetrical locks 12 project out from outer side surfaces of opposite left and right side walls of the receptacle 11. The locks 12 are in the form of projections and engage the lock arms 30 to lock the two connectors F, M in a properly connected state.

Figure 1:
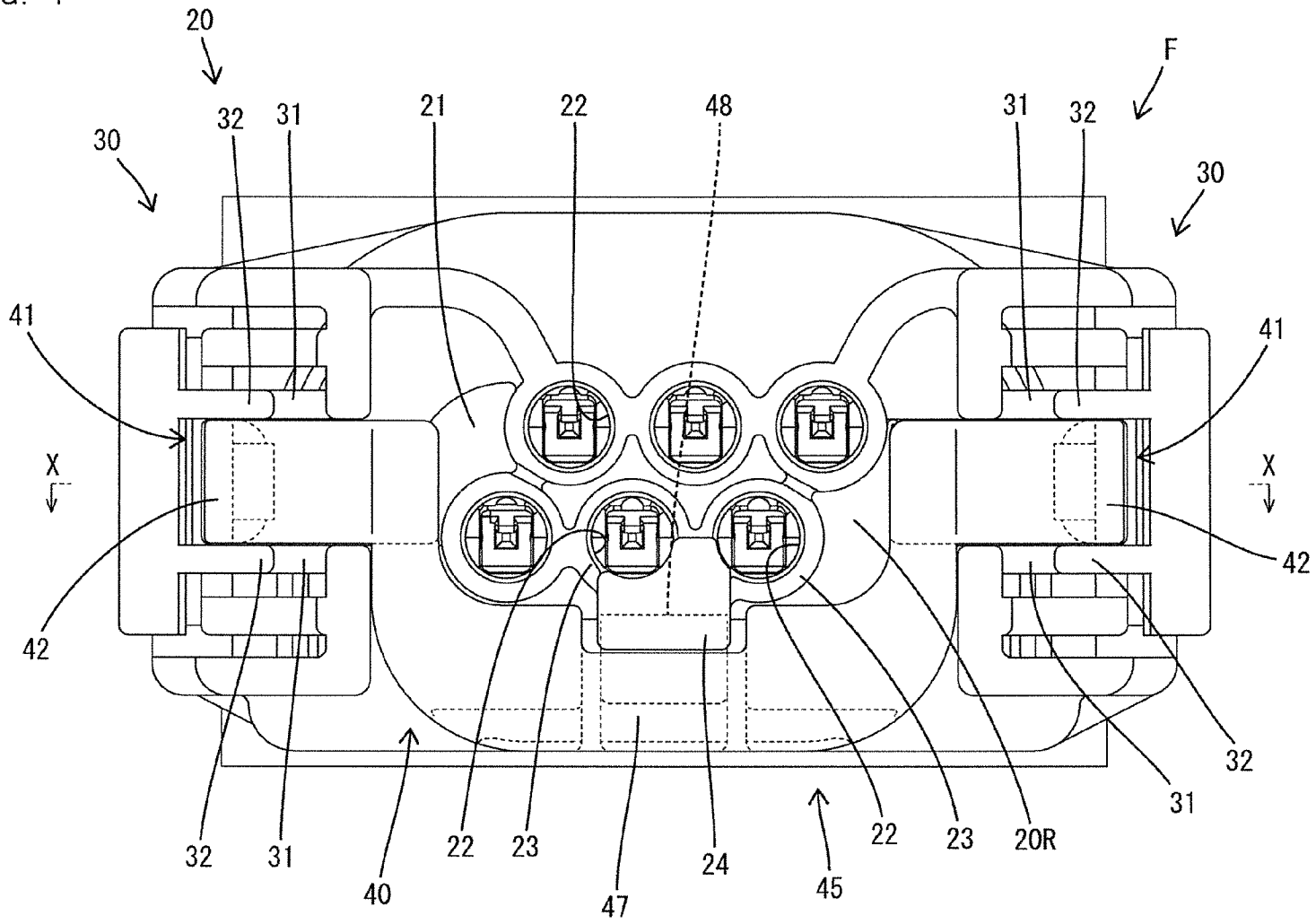
FIG. 1 is a rear view of a connector of one embodiment.
Figure 2:
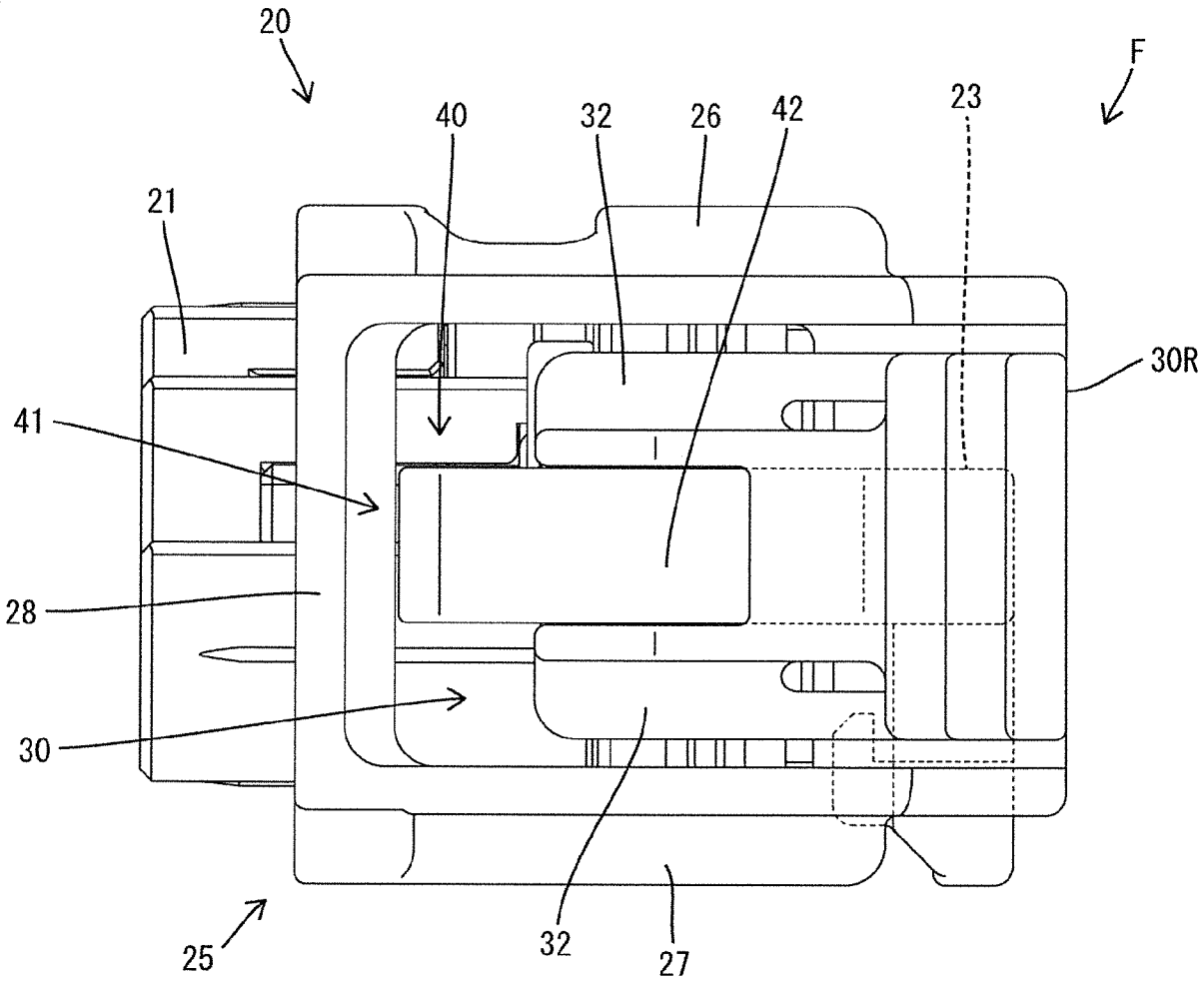
FIG. 2 is a side view of the connector.
Figure 3:
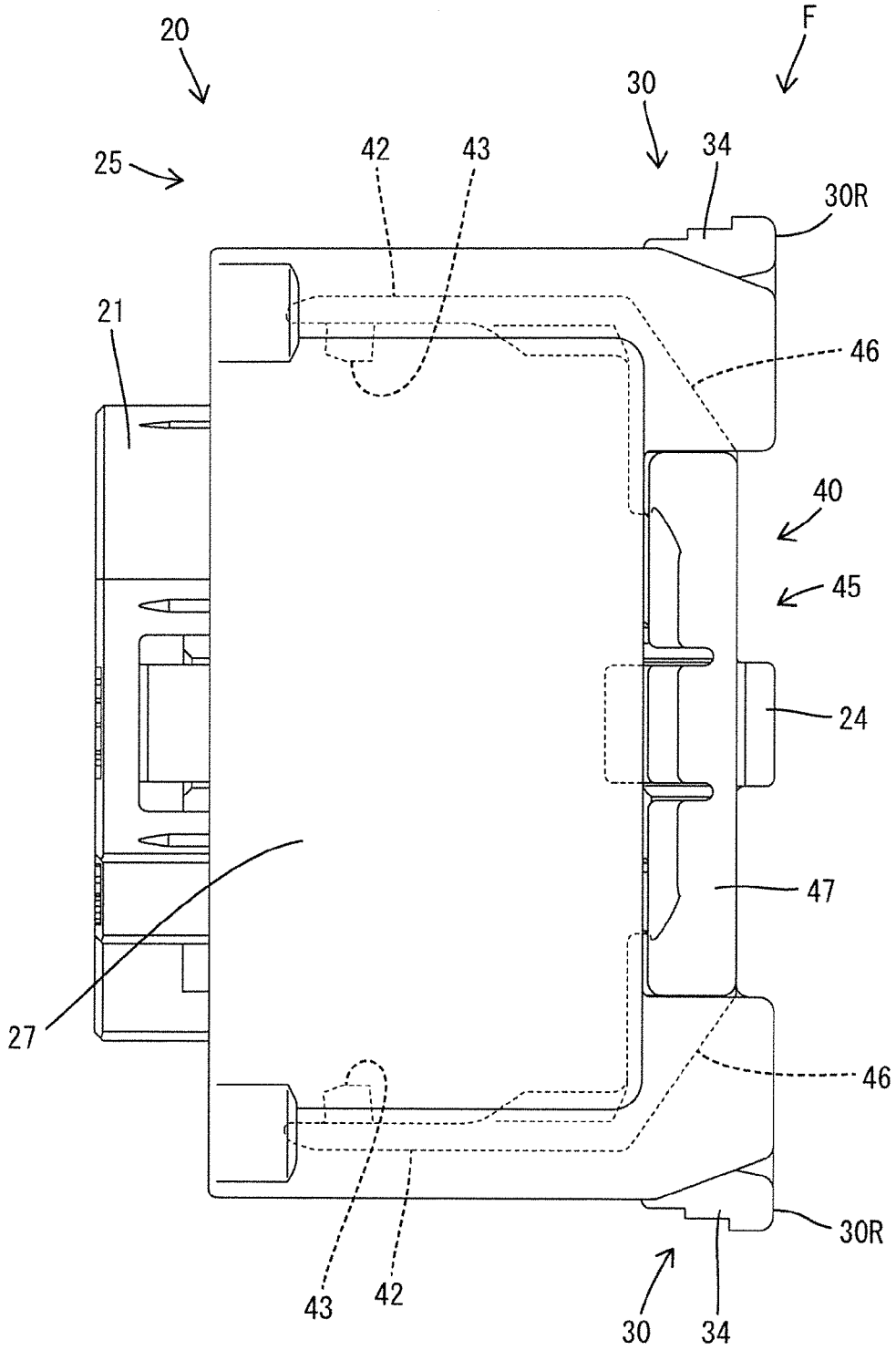
FIG. 3 is a bottom view of the connector.
Figure 8:
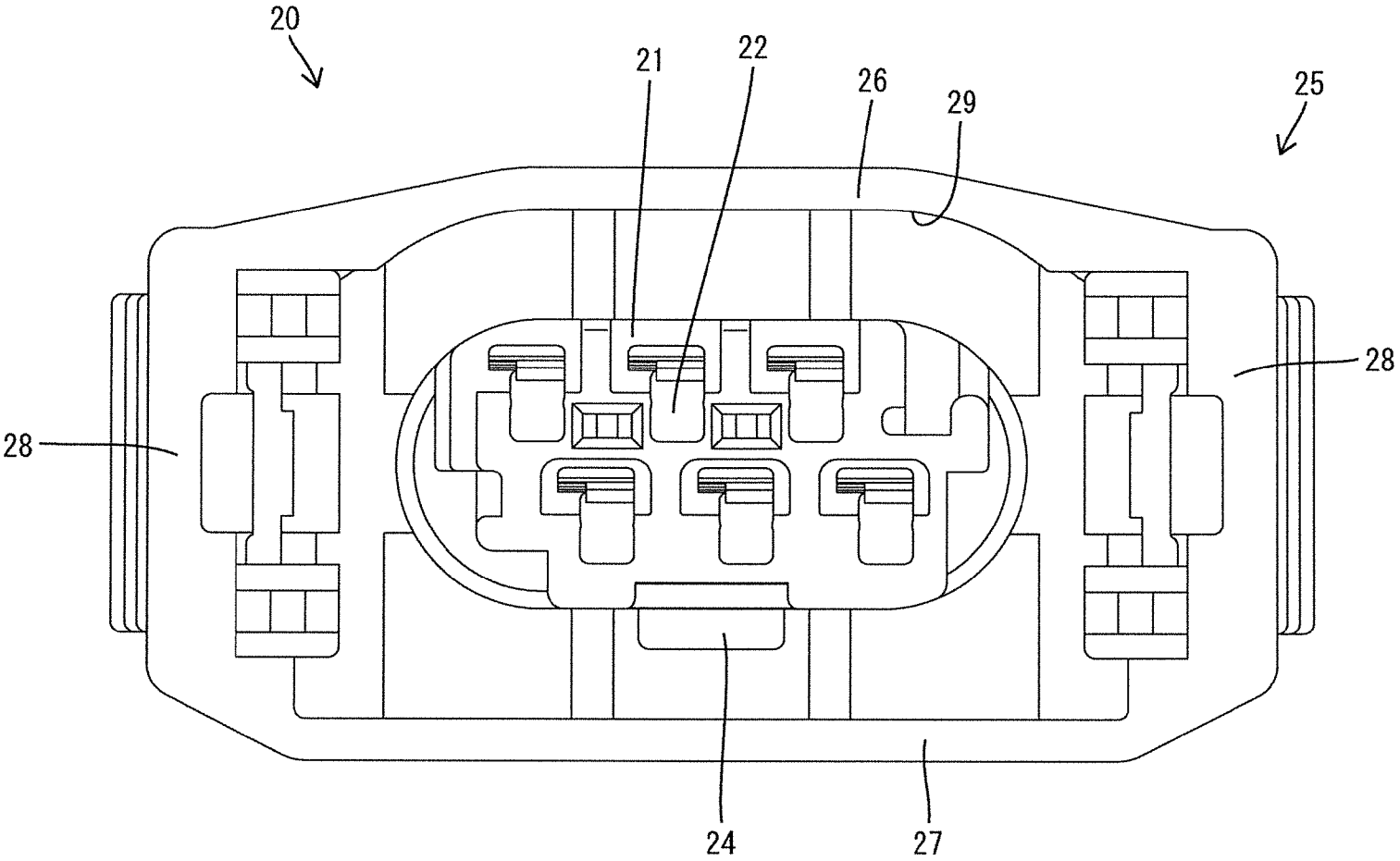
FIG. 8 is a front view of a housing.
Figure 9:
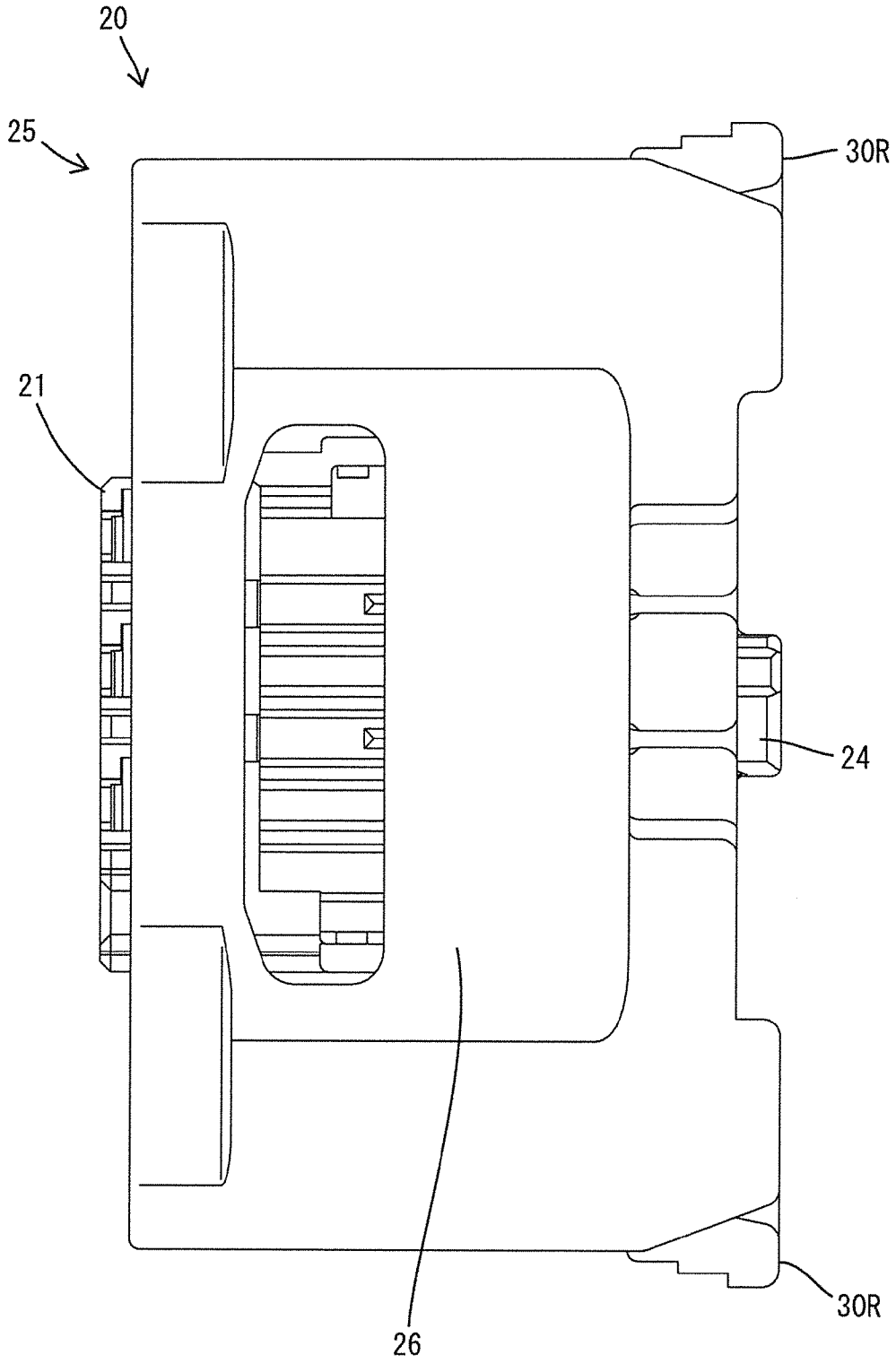
FIG. 9 is a plan view of the housing.

The female connector F is formed by assembling a housing 20 and the connection detector 40, both of which are made of synthetic resin. As shown in FIGS. 8 and 9, the housing 20 has a terminal accommodating portion 21 and a frame 25. The terminal accommodating portion 21 is a block that is to be fit into the receptacle 11. The frame 25 surrounds the terminal accommodating portion 21 and is to surround the receptacle 11 when the connectors F, M are connected. A plurality of terminal accommodating chambers 22 are formed in the terminal accommodating portion 21, as shown in FIGS. 1 and 8.

The terminal accommodating chambers 22 are arranged in an offset manner in upper and lower rows. A female terminal fitting (not shown) is inserted into each terminal accommodating chamber 22 from behind the housing 20 (right side in FIGS. 4 to 7). A rear end part of each terminal accommodating chamber 22 projects back from a rear surface 20R of the terminal accommodating portion 21 of the housing 20 to define individual seal towers 23. Parts of the outer peripheral surfaces of the seal towers 23 are coupled to each other. The inner peripheral surfaces of the seal towers 23 function as a waterproof seal surfaces.

A stopper 24 is formed on the rear surface 20R of the housing 20. As shown in FIG. 1, the stopper 24 is connected to lower areas of the outer peripheral surfaces of the seal towers 23 in the lower row. The stopper 24 is a projection projecting down from rear end parts of the seal towers 23. The stopper 24 is arranged at a lateral central position of the housing 20 and functions to holding the connection detector 40 at an initial position.

The frame 25 has upper and lower walls 26 and 27 and left and right coupling portions 28, as shown in FIGS. 2, 3, 8 and 9. The upper wall 26 extends forward from the rear end of the terminal accommodating portion 21 and faces the upper surface of the terminal accommodating portion 21. The lower wall 27 also extends forward from the rear end of the terminal accommodating portion 21 and faces the lower surface of the terminal accommodating portion 21. The left and right coupling portions 28 couple front end parts of opposite left and right edges of the upper and lower walls 26 and 27. A space between the outer periphery of the terminal accommodating portion 21 and the frame 25 defines a connection space 29 into which the receptacle 11 is to be fit.

Two arms 30 are arranged bilaterally symmetrically to extend along the opposite left and right outer side surfaces of the terminal accommodating portion 21, as shown in FIGS. 4 to 7. The lock arms 30 are arranged behind the coupling portions 28. Further, the lock arms 30 are arranged substantially in a vertically central part of the housing 20. Each lock arm 30 has a leg 31 connected to a rear end part of the corresponding outer side surface of the terminal accommodating portion 21 and arms 32 are cantilevered both forward and backward from each leg 31. Each arm 32 is resiliently deformable in a seesaw-like manner in a lateral direction with the legs 31 as supporting points.

An interfering portion 33 is formed on a front end part of the lock arm 30 and bridges front end parts of the arms 32. Further, an unlocking portion 34 is formed on a rear end part of the lock arm 30 and couples rear end parts of the arms 32. The lock arm 30 can be displaced resiliently to an unlocking position by pressing the unlocking portion 34. A rear end 30R of the lock arm 30 is located behind the rear surface 20R of the housing 20 and slightly behind the rear ends of the seal towers 23. Thus, a space between the rear surface 20R of the housing 20 and the rear ends 30R of the lock arms 30 is a dead space.

As shown in FIGS. 10 to 13, the connection detector 40 is formed by unitarily molding two bilaterally symmetrical connection detection function portions 41 and a bilaterally symmetrical detecting portion 45 that couples rear end parts of the connection detection function portions 41. Each connection detection function portion 41 includes a resilient locking piece 42 cantilevered forward and a butting portion 43 projecting in (toward the outer side surface of the terminal accommodating portion 21) from an area slightly behind the front end of the resilient locking piece 42. A front end part of the resilient locking piece 42 defines a hook 44 projecting farther forward than the butting portion 43. Rear parts of the connection detection function portions 41 are connected to opposite left and right end parts of the detecting portion 45. The resilient locking piece 42 is resiliently deformable laterally with a rear end part thereof connected to the detecting portion 45 substantially as a support.

Figure 10:
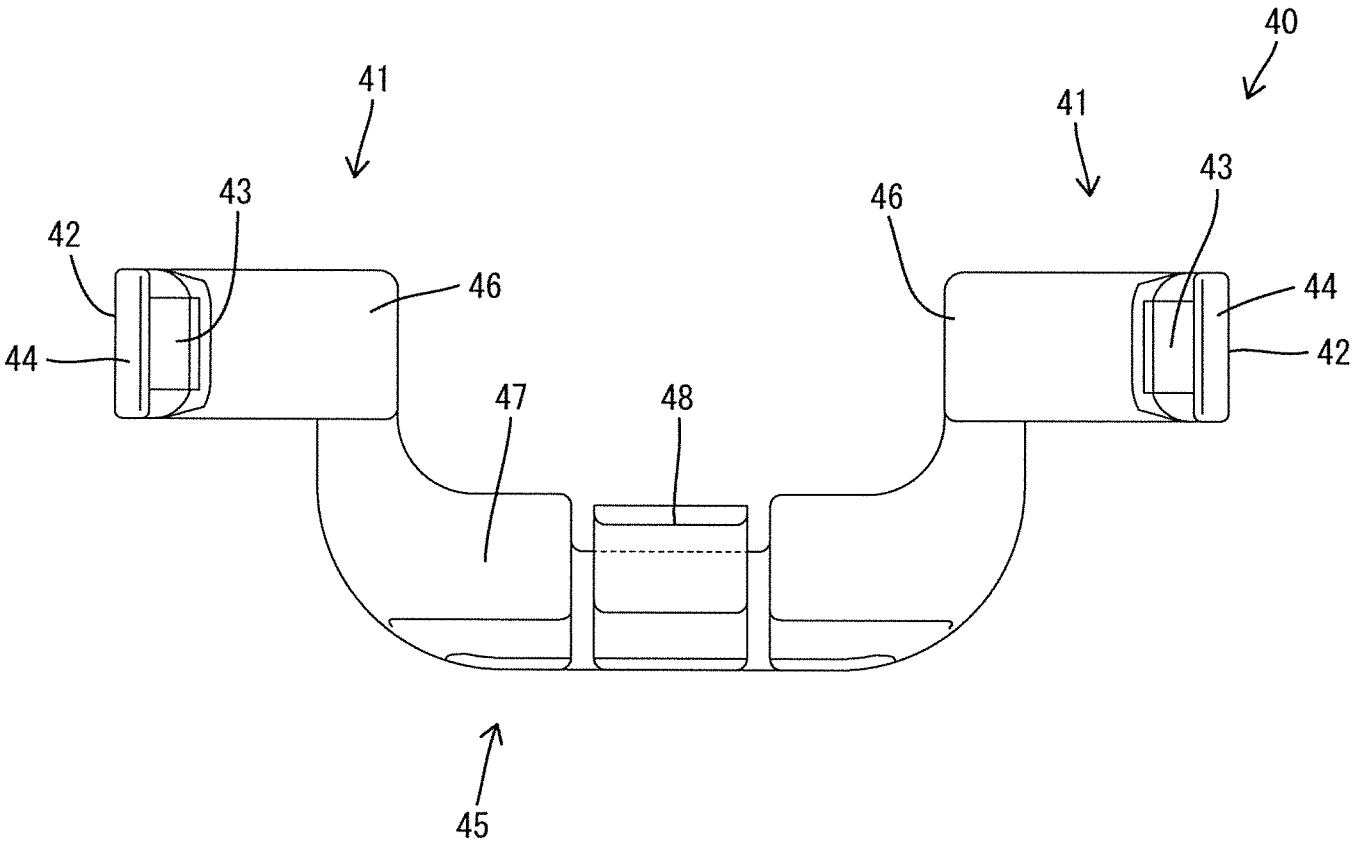
FIG. 10 is a front view of the connection detector.
Figure 11:
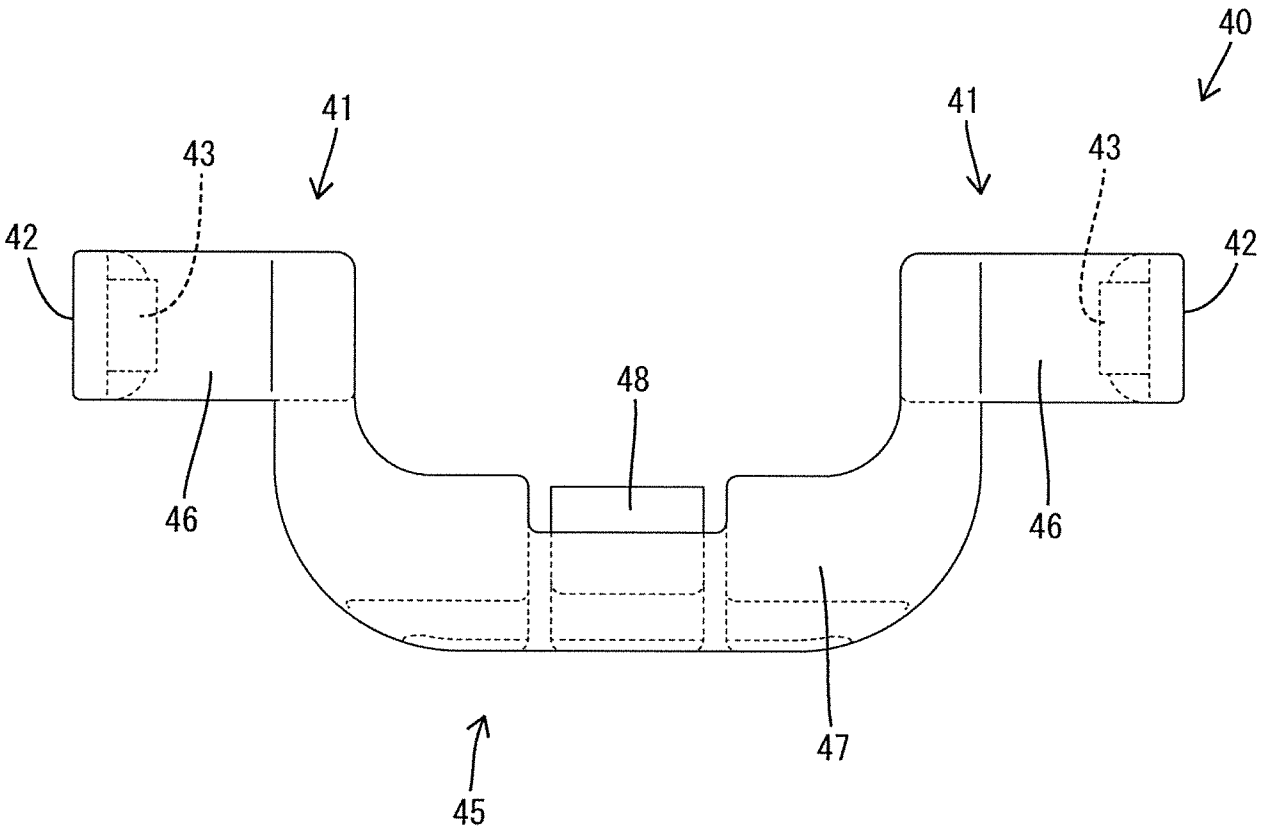
FIG. 11 is a rear view of the connection detector.
Figure 12:
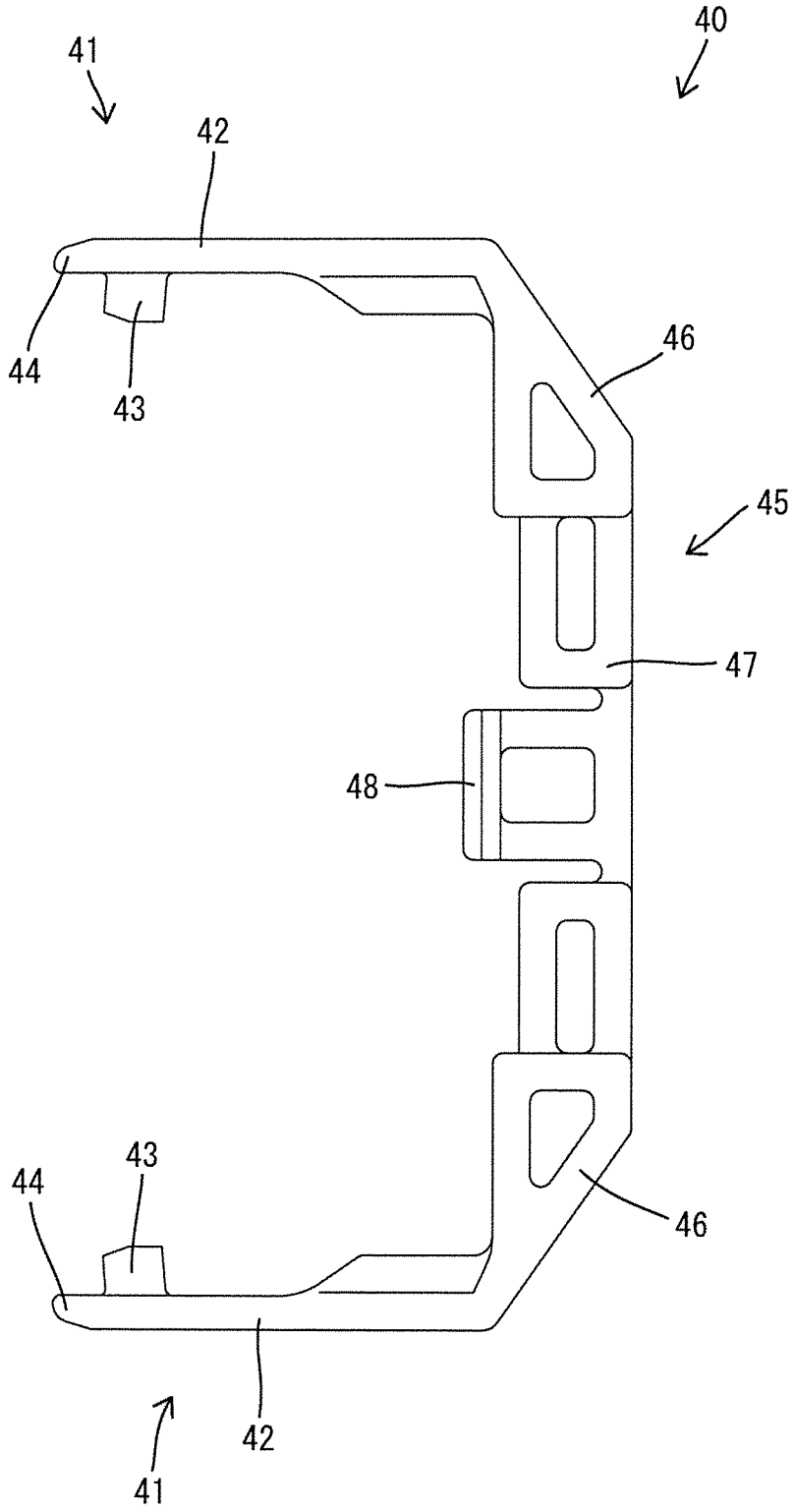
FIG. 12 is a plan view of the connection detector.

The detecting portion 45 extends in the lateral direction, as shown in FIGS. 1, 10 and 11, and is formed by integrally molding two bilaterally symmetrical supports 46 connected substantially at a right angle to rear ends of the resilient locking pieces 42 and a bent portion 47 coupling the supports 46. The supports 46 are arranged at the same height as the resilient locking pieces 42. The bent portion 47 is bent to be substantially U-shaped in a rear view. In the rear view, upwardly extending left and right end parts of the bent portion 47 are connected substantially at a right angle to the supports 46.

Figure 13:
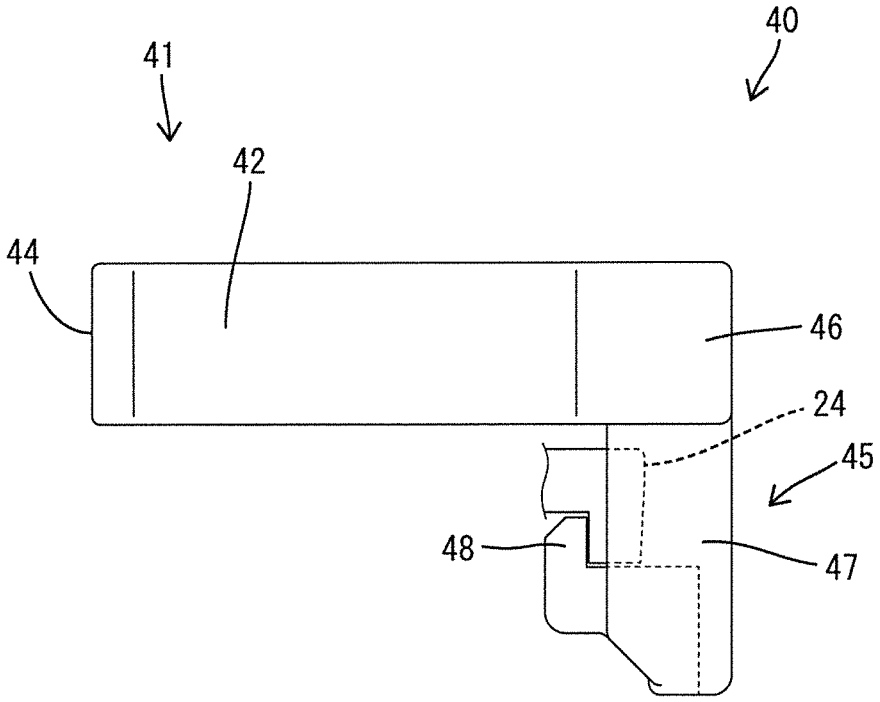
FIG. 13 is a side view of the connection detector.

The detecting portion 45 is formed with a lock 48 for holding the connection detector 40 at the initial position. As shown in FIG. 13, the lock 48 projects forward from the detecting portion 45 and then is bent to extend up. Thus, the lock 48 is substantially L-shaped in side view. The lock 48 is arranged in a laterally central part of the detecting portion 45.

The connection detector 40 is assembled with the housing 20 from behind. In an assembled state, as shown in FIG. 4, the resilient locking pieces 42 are accommodated between the outer side surfaces of the terminal accommodating portion 21 and the inner surfaces of the lock arms 30. Additionally, the detecting portion 45 extends along the rear surface 20R of the terminal accommodating portion 21 (housing 20). In a state before the two connectors F, M are connected, the connection detector 40 is held at the initial position shown in FIGS. 4 to 6 by locking the connection detection function portions 41 and the lock arms 30 to each other. When the two connectors F, M are connected properly, the connection detector 40 is movable from the initial position to a detection position shown in FIG. 7.

At the initial position, the butting portions 43 of the connection detector 40 are locked in contact with the interfering portions 33 of the housing 20 from behind and the lock 48 of the connection detector 40 is locked to the stopper 24 of the housing 20 from the front. These locking actions hold the connection detector 40 at the initial position and restrict displacement of the connection detector 40 in the front-back direction with respect to the housing 20. Further, the connection detector 40 is movable from the initial position to the detection position shown in FIG. 7 when the butting portions 43 and the interfering portions 33 are unlocked from each other.

Figure 5:
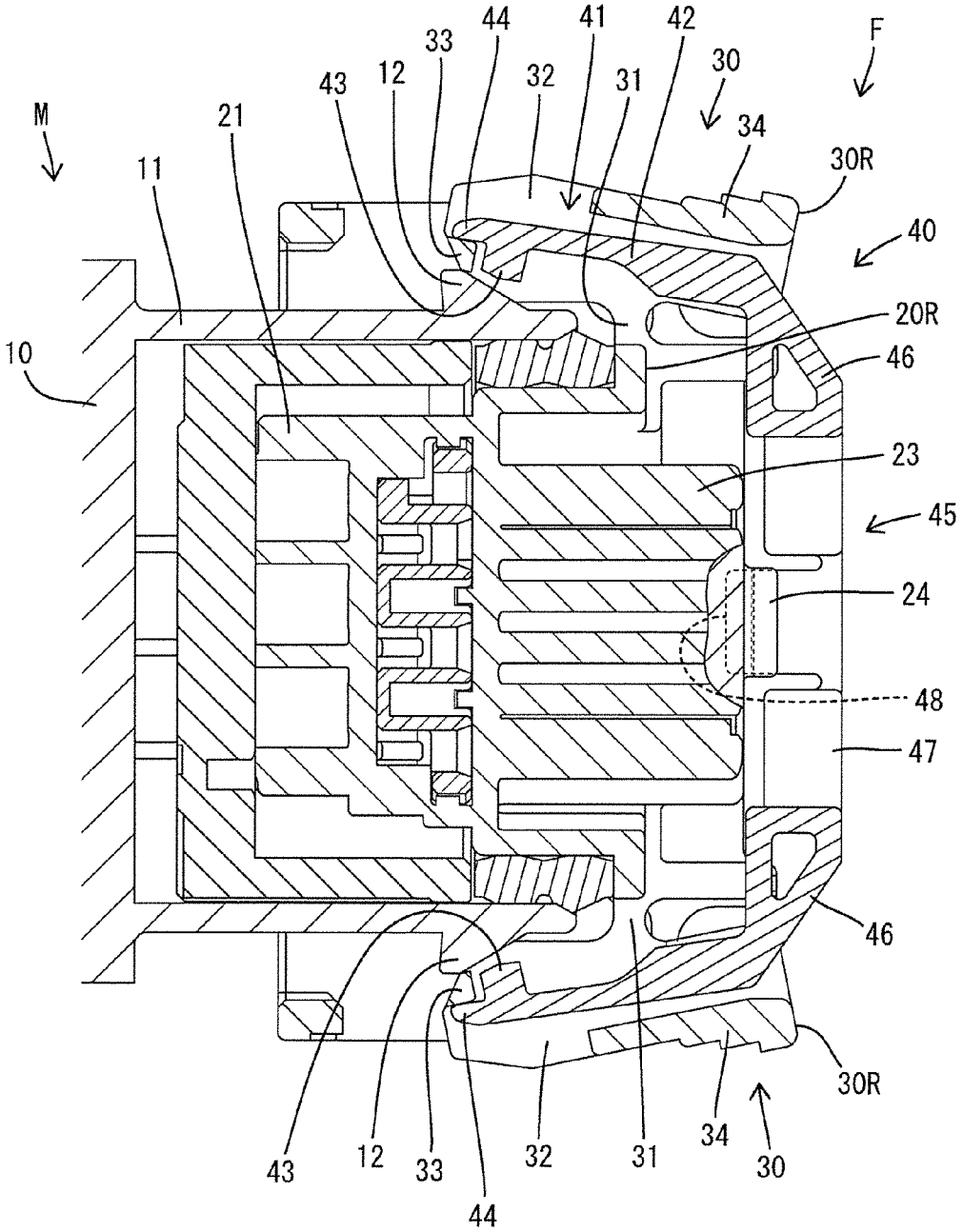
FIG. 5 is a section along X-X of FIG. 1 showing a process of connecting the connector and the mating connector

The receptacle 11 is inserted into the connection space 29 to start the connection of the two connectors F, M. The interfering portions 33 of the lock arms 30 move onto the locks 12 of the mating connector M in the process of connecting the connectors F, M, as shown in FIG. 5. Thus, the lock arms 30 deform resiliently to the unlocking positions. At this time, the interfering portions 33 of the lock arms 30 are locked to the hooks 44 of the connection detector 40 from inner sides to push the hooks 44 out. The resilient locking pieces 42 deform resiliently to follow the lock arms 30.

Figure 6:
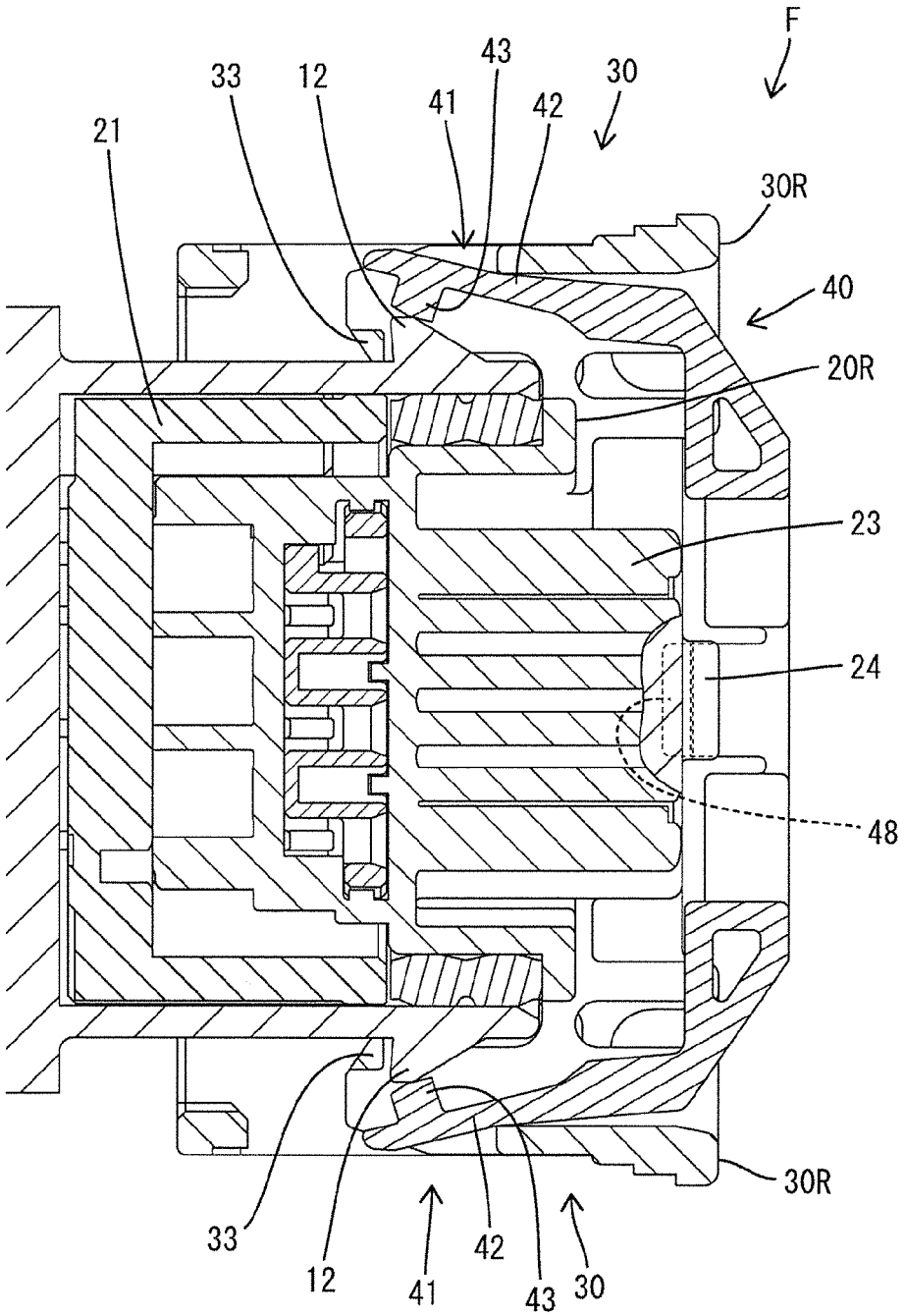
FIG. 6 is a section along X-X of FIG. 1 showing a state where the connector and the mating connector are connected properly.

The interfering portions 33 of the lock arms 30 pass over the lock portions 12 when the connectors F, M reach a properly connected state, as shown in FIG. 6. Thus, the lock arms 30 resiliently return to locking positions so that the separation of the two connectors F, M is restricted by the locking action of the interfering portions 33 and the locks 12. The interfering portions 33 and the locks 12 are locked to each other on the opposite left and right outer side surfaces of the housing 20. Thus, the two connectors F, M are locked reliably in the properly connected state.

Figure 7:
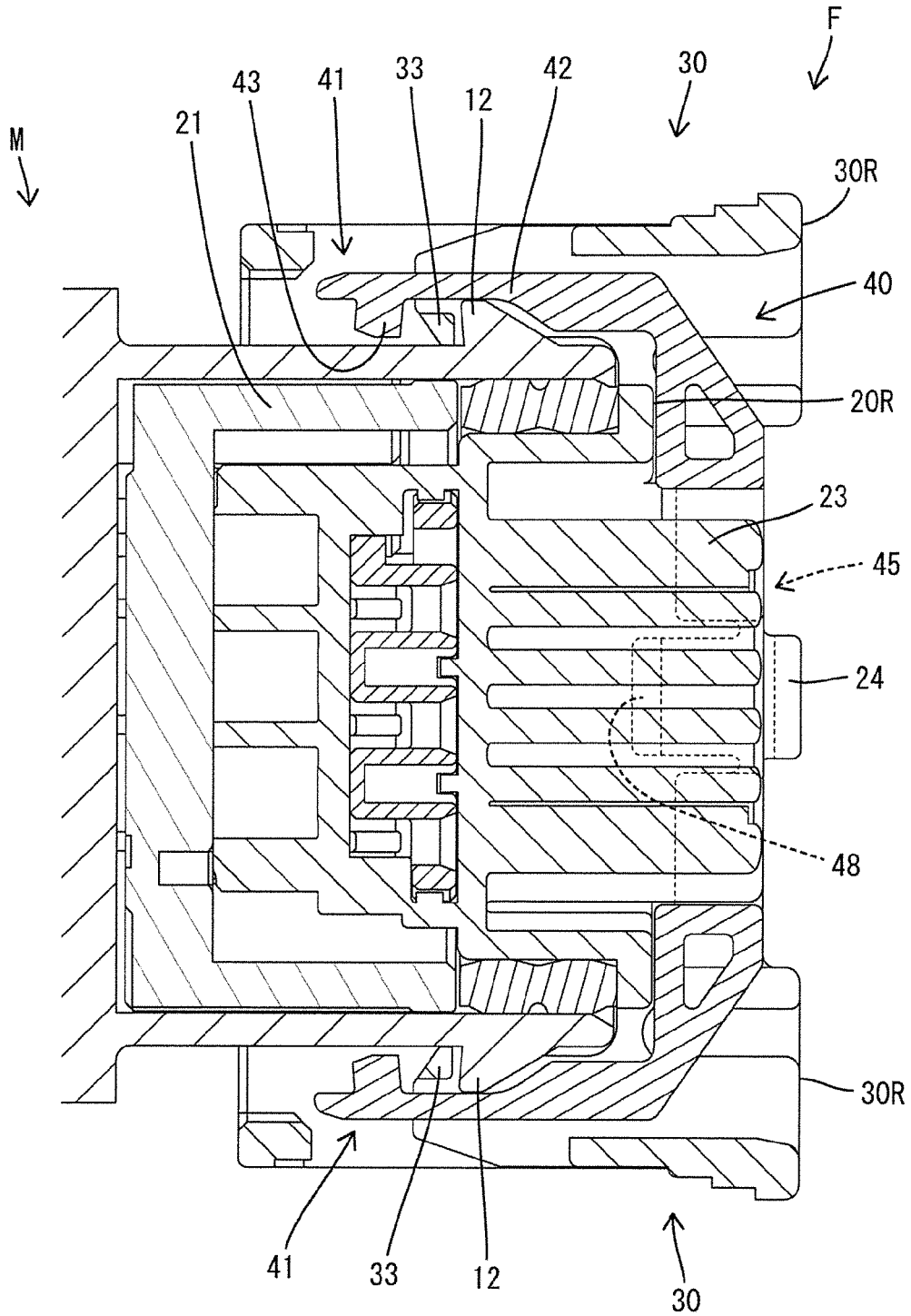
FIG. 7 is a section along X-X of FIG. 1 showing a state where a connection detector has moved from an initial position to a detection position.

The butting portions 43 of the resilient locking pieces 42 are kept on the locks 12 in the properly connected state so that the resilient locking pieces 42 do not resiliently return. That is, the lock arms 30 are displaced inward with respect to the resilient locking pieces 42 and, associated with that, the interfering portions 33 are disengaged from the butting portions 43. Disengagement of the interfering portions 33 from the butting portions 43 releases the connection detector 40 form a state where a forward movement thereof is restricted, and hence the connection detector 40 becomes movable to the detection position. After the connecting operation of the two connectors F, M is finished, a finger is brought into contact with the detecting portion 45 from behind to push the detecting portion 45 forward. The connection detector 40 then is pushed forward and moves to the detection position, as shown in FIG. 7.

One or both of the of lock arms 30 remains on the locks 12 if the connection of the two connectors F, M is not finished completely. In this case, the butting portion 43 is locked to or proximately faces the interfering portion 33 of the lock arm 30 from behind. Thus, an attempt to push the connection detector 40 forward to the detection position is restricted by locking the interfering portion 33 and the butting portion 43 to each other.

As described above, the connection detector 40 is permitted to move to the detection position in a state where both of the lock arms 30 have resiliently returned (i.e. completely locked state). However, the connection detector 40 cannot be pushed to the detection position if at least one of the lock arms 30 is kept on the lock 12 and has not yet resiliently returned to the locking position (i.e. incompletely locked state). In this way, the connection detector 40 can reliably detect whether the properly connected connectors F, M are locked completely.

The female connector F of this embodiment includes the two lock arms 30 and connection is detected by the connection detector 40 including the two connection detection function portions 41 individually corresponding to the two lock arms 30. The stopper 24 is provided on the housing 20 and the lock 48 is provided on the connection detector 40 for keeping the connection detector 40 at the initial position. The lock 48 is locked to the stopper 24, thereby restricting a movement of the connection detector 40 at the initial position toward a side opposite to the detection position to be separated from the housing 20.

The lock 48 is formed on the detecting portion 45 in this embodiment. If the lock 48 was provided individually on each of the connection detection function portions 41, the structure and shape of the connection detection function portions 41 would be complicated. However, in this embodiment, the lock 48 is provided only at one position of the detecting portion 45 to avoid a complicated shape and structure of the connection detection function portions 41. In this way, the structure of the connection detector 40 is simplified.

The housing 20 can be connected to the male connector M with the connection detector 40 detached, and the stopper 24 projects from the rear surface 20R opposite to a front surface in a connecting direction to the male connector M and is bent to be substantially L-shaped. According to this configuration, the housing 20 can be used with the connection detector 40 detached, and an operation of separating the male connector M from the housing 20 can be performed easily by placing a finger on the stopper 24.

The housing 20 is formed with the plural terminal accommodating chambers 22 and the seal towers 23 constituting the rear end parts of the terminal accommodating chambers 22 project from the rear surface 20R of the housing 20. The stopper 24 is connected to the outer surfaces of the seal towers 23. According to this configuration, the stopper 24 has high strength and reliably restricting separation of the connection detector 40 as compared with a stopper singly projecting back from the rear surface 20R of the housing 20. In addition, the outer peripheral surfaces of the seal towers 23 are curved so that the stopper 24 is more rigid.

The detecting portion 45 extends along the rear surface 20R of the housing 20 and is bent to avoid the seal towers 23. In this way, the interference of the detecting portion 45 and the seal towers 23 is avoided.

Rear ends 30R of the lock arms 30 are located behind the rear surface 20R of the housing 20 and the area behind the rear surface 20R of the housing 20 is a dead space due to this displacement in the front-back direction. Accordingly, in this embodiment, the detecting portion 45 is accommodated in this dead space, to which the rear surface 20R of the housing 20 is facing, in a state where the connection detector 40 is at the detection position. In this way, the miniaturization of the connector in the front-back direction is realized.

The invention is not limited to the above described embodiment, and the following embodiments are also included in the scope of the invention.

Although the detecting portion is bent to avoid the seal towers in the above embodiment, it may have a straight shape.

The dead space is formed behind the rear surface of the housing by arranging the rear ends of the lock arms behind the rear surface of the housing in the front-back direction. However, the rear ends of the lock arms may be arranged at the same position as or before the rear surface of the housing.

The seal towers project from the rear surface of the housing in the above embodiment, but the housing may be formed so that the seal towers do not project therefrom.

The stopper is connected to the outer peripheral surfaces of the seal towers in the above embodiment. However, the stopper may project back from the rear surface of the housing.

LIST OF REFERENCE SIGNS

F . . . female connector
M . . . male connector
20 . . . housing
20R . . . rear surface of housing
22 . . . terminal accommodating chamber
23 . . . seal tower
24 . . . stopper
30 . . . lock arm

30R . . . rear end of lock arm
40 . . . connection detector
41 . . . connection detection function portion
45 . . . detecting portion
48 . . . locking portion

What is claimed is:

1. A connector, comprising:

a housing which is connectable to a mating connector;

two lock arms formed respectively on opposite left and right side surfaces of the housing, the lock arms being resiliently deformed due to interference with locks formed on the mating connector in the process of connecting the mating connector and the housing, and disengaged from the locks to resiliently return when the mating connector and the housing are connected properly;

a connection detector movably mounted on the housing and having two connection detection function portions corresponding to the lock arms and connected by a detecting portion, the connection detector being held at an initial position by locking the connection detection function portions and the lock arms to each other in a state where the mating connector and the housing are not properly connected, and permitted to move to a detection position by unlocking the connection detection function portions and the lock arms from each other in a state where the mating connector and the housing are connected properly;

a stopper formed on the housing; and a lock formed on the detecting portion and being locked to the stopper to restrict movement of the connection detector from the initial position in a direction away from the detection position to be separated from the housing.

2. The connector of claim 1, wherein:

the housing is connectable to the mating connector with the connection detector detached, and the stopper projects from a rear surface opposite to a front surface in a connecting direction to the mating connector and is bent to be substantially L-shaped.

3. The connector of claim 1, further comprising:

terminal accommodating chambers formed in the housing; and seal towers constituting rear end parts of the terminal accommodating chambers and projecting from a rear surface of the housing;

wherein the stopper is connected to outer surfaces of the seal towers.

4. The connector of claim 1, further comprising:

terminal accommodating chambers formed in the housing; and seal towers constituting rear end parts of the terminal accommodating chambers and projecting from a rear surface of the housing;

wherein the detecting portion extends along the rear surface of the housing and is bent to avoid the seal towers.

5. The connector of claim 1, wherein:

rear ends of the lock arms are located behind a rear surface of the housing; and the detecting portion is arranged to be in contact with or proximately face the rear surface of the housing when the connection detector is at the detection position.

* * * * *